US006295656B1

(12) United States Patent
Tillen

(10) Patent No.: US 6,295,656 B1
(45) Date of Patent: Oct. 2, 2001

(54) VENTING APPARATUS FOR FLUSH TOILETS

(76) Inventor: Bruce Tillen, 3200 Mount Royal Drive, Cranbrook, British Columbia (CA), V1C 5R8

( * ) Notice: Subject to any disclaimer, the term of this patent is extended or adjusted under 35 U.S.C. 154(b) by 0 days.

(21) Appl. No.: 09/457,001

(22) Filed: Dec. 8, 1999

Related U.S. Application Data

(63) Continuation-in-part of application No. 09/300,446, filed on Apr. 29, 1999, now Pat. No. 6,073,273.
(60) Provisional application No. 60/083,690, filed on Apr. 30, 1998.

(51) Int. Cl.[7] ..... E03D 9/04
(52) U.S. Cl. ..... 4/216; 4/347; 4/352
(58) Field of Search ..... 4/213, 216, 347–352, 4/405, 411, 412

(56) References Cited

U.S. PATENT DOCUMENTS 900,831 * 10/1908 Charlton ..... 4/214
1,276,965 * 8/1918 Rowe .
1,298,171 * 3/1919 Burdin ..... 4/214
1,381,710 * 6/1921 Krantz et al. ..... 4/214
1,520,554 * 12/1924 Ankeny et al. .
2,603,797 * 7/1952 Baither ..... 4/214
4,153,956 * 5/1979 Fischer, Sr. et al. ..... 4/213
4,933,995 * 6/1990 Canon ..... 4/213
5,044,018 * 9/1991 Gandini ..... 4/216
5,257,421 * 11/1993 Rose et al. ..... 4/214
5,386,594 * 2/1995 Hilton ..... 4/213
5,575,019 * 11/1996 Kijewski ..... 4/213
5,689,837 * 11/1997 Katona ..... 4/214

* cited by examiner

*Primary Examiner*—Charles R. Eloshway
(74) *Attorney, Agent, or Firm*—Antony C. Edwards

(57) ABSTRACT

A toilet venting apparatus includes an upper insert mountable between a toilet tank and a toilet bowl, and a lower insert mountable between the bowl and a floor sewer pipe. The upper insert cooperates with the toilet bowl for removal of gases in the bowl through apertures in the bowl rim. A motor driven fan extracts the gases through the upper insert and forces the gases along the lower insert into the sewer. The fan is remotely activated. Flushing the toilet disables the fan until reactuated following flushing.

15 Claims, 13 Drawing Sheets

18
8
10
24
80
34
14
15
12
20
A
16
6a
26
82
32

6
32
61
62
50
30

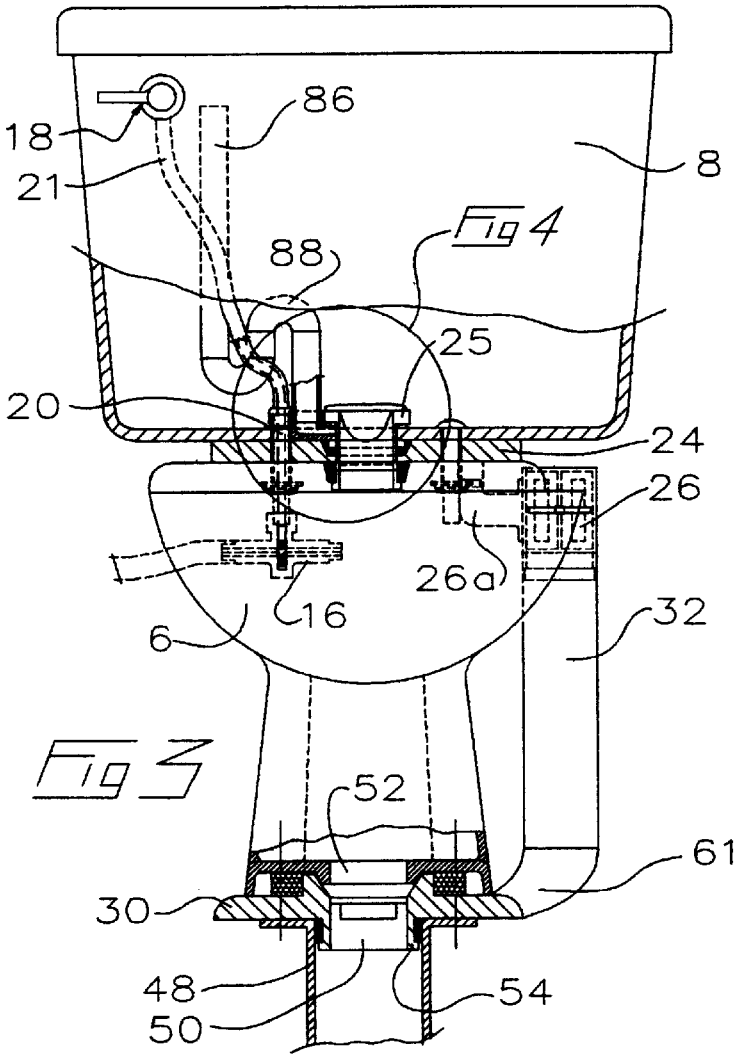
Fig 4
Fig 3
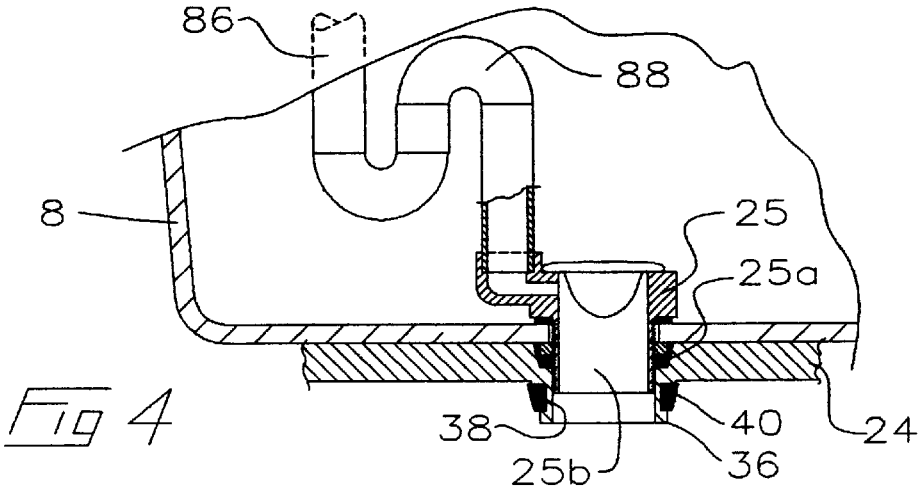
Fig 4

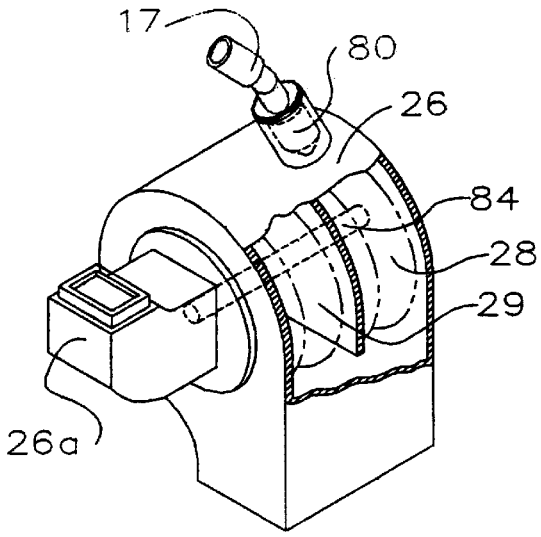
Fig 9
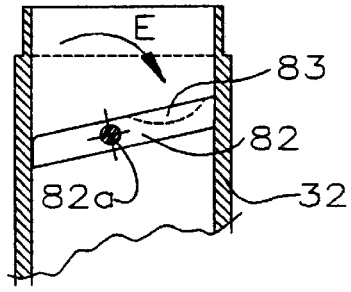
Fig 10
Fig 11
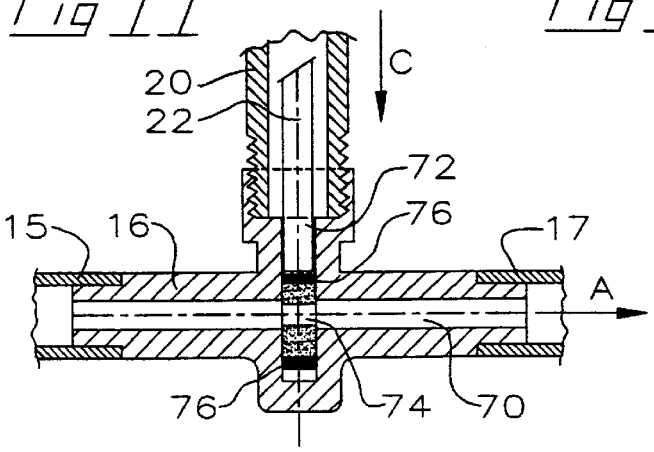
Fig 12
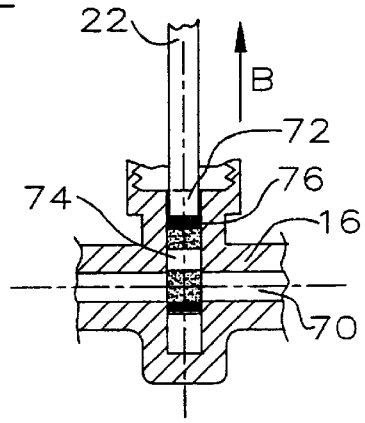

VENTING APPARATUS FOR FLUSH TOILETS

CROSS REFERENCE TO RELATED APPLICATION

This Continuation-In-Part application claims priority from United States Provisional Patent Application No. 60/083,690 filed Apr. 30, 1998 titled Odour Venting For Toilets and U.S. patent application Ser. No. 09/300,446 filed Apr. 29, 1999 now U.S. Pat. No. 6,073,273.

FIELD OF THE INVENTION

This invention relates to a selectively operable hydraulically actuated venting apparatus for flush toilets which removes air from the bowl of the toilet through the flush passages located around the upper interior perimeter of the toilet bowl. In particular, manual activation of the venting cycle precedes the flushing cycle of the toilet and actuation of the toilet flush lever cancels the venting cycle.

BACKGROUND OF THE INVENTION

A basic North American toilet consists of two major components, a tank and a bowl. The rectangular tank has an approximate capacity of two gallons of water. Connected to the tank is a water line which provides a pressurized source of clean water to the tank. The water stored in the tank empties into the bowl through an aperture controlled by a tank or ball valve. A chain is attached at one end of the chain to a flush handle on the outside of the tank. The other end of the chain is attached to the tank valve. Actuating, the flush handle pulls the chain and lifts the tank valve to allow water from the tank through the aperture and into the bowl. A float is also attached to the flushing system in the tank, which gauges when sufficient water has refilled the tank and allows the tank valve to close over the aperture into the bowl.

The bowl is located below the tank. The bowl may approximate a hemispherical shape. A seat is fitted to the upper edge defined by the planer circumference of the hemisphere. The bottom of the bowl has an aperture which cooperates with a pipe, the pipe forms an upside-down U-shape located directly behind the bowl. The top or apex of the inverted "U" is higher than the bottom of the bowl. The pipe continues down to an exit aperture connected to the sewer pipe opening in the floor. The toilet bowl is mounted over the sewer pipe opening. Water in the bowl and in the pipe will be at the same level, leaving an air pocket in the top of the inverted "U". The air pocket allows for a siphoning action required for flushing.

Water flowing from the tank down into the bowl causes a surge in the bowl. The surge causes water to push into the pipe, upwards around the apex of the "U" in the pipe, pushing the air pocket down into the sewer. This creates a siphon which draws a continuous flow of water from the tank into the bowl and through the pipe. When the tank empties so that there is no more water in the bowl, air fills the "U" in the pipe, stopping the siphon. Once the siphon is interrupted, water fills the tank and re-fills the bowl. The water stops flowing into the bowl when the float in the tank rises with the water level in the tank to a high enough level which allows the tank valve to close. The water level will find itself between the bottom of the bowl and a horizontally equal level in the lower leg of the pipe.

In the prior art, applicant is aware of U.S. Pat. No 5,257,421 which issued Nov. 2, 1993 to Rose et al for an Air Fresh Toilet. Rose et al disclose the use of a toilet bowl having an auxiliary passageway built-in to the rear of the bowl and housing a water driven ventilation fan thereon. Water valves are coupled to use of the toilet seat so that weight placed on the seat initiates the fan turbine which runs the fan until the weight is removed from the seat. The disclosed design of the bowl requires that a conventional toilet bowl has to be entirely replaced, rather than providing for retrofit to conventional toilets as in the present invention.

SUMMARY OF THE INVENTION

In summary, the toilet venting apparatus of the present invention includes an upper insert mountable between a toilet tank and a toilet bowl, and a lower insert mountable between the bowl and a floor sewer pipe. The upper insert has a first aperture therethrough cooperating between a flush valve aperture in a lower wall of the tank and a water-entry aperture in an upper surface of the bowl. The water-entry aperture cooperates, via a manifold in the bowl, in fluid communication with water dispensing apertures around an upper rim of the bowl.

A flush valve in the tank is actuable so as to release flush water held in the tank through the flush valve aperture, the first aperture, the water-entry aperture, the manifold and the water dispensing apertures to thereby flush the toilet. The upper insert has a first conduit in fluid communication with the first aperture. The first conduit extends from the first aperture to a first outlet. The first outlet opens externally from the upper insert. The lower insert has a second aperture therethrough cooperating between a down-leg discharge aperture of the bowl and an inlet aperture of the floor sewer pipe. The lower insert has a second conduit in fluid communication with the second aperture. The second conduit extends from the second aperture to a second outlet. The second outlet opens externally from the lower insert.

A third conduit is mountable in fluid communication between the first and second outlets. A water driven turbine is mounted to the third conduit. A water supply is mounted to an impeller side of the turbine. An actuator, for biasing to an open position a water supply valve is mounted on the water supply. The water supply water is fed under pressure to the impeller side of the turbine. Water flows through a nozzle to thereby turn an impeller of the turbine. The impeller is co-axially mounted to a fan of the turbine. The fan is in fluid communication with the third conduit.

Thus, when the first insert is mounted between the tank and the bowl, and when the second insert is mounted between the bowl and the floor sewer pipe, and when the third conduit is mounted to the first and second outlets, turning of the impeller turns the fan so as to draw air into the third conduit from the bowl. Air is drawn from the bowl via the water dispensing apertures, the manifold and the first conduit. The fan urges the air down the third conduit, so as to pass through the second conduit and into the floor sewer pipe.

In one aspect of the present invention the actuator is a manual water supply valve actuator manually operable between first and second water supply valve biasing positions. In the first water supply valve biasing position the water supply valve is biased into the open position. Operation of a flush valve linkage for actuating the flush valve biases, by a return actuator cooperating with the flush valve linkage, the manual water supply valve actuator from the first water supply valve biasing position to the second water supply valve biasing position. In the second water supply valve biasing position the water supply valve is biased into a closed position.

In a further aspect, the manual water supply valve actuator is a plunger. The plunger is mounted to a first end of a mechanical water supply valve linkage. An opposite second end of the water supply valve linkage is mounted to the water supply valve in cooperation therewith for opening and closing the water supply valve upon corresponding translation of the plunger. The plunger is cooperatively mounted to a flush valve linkage actuator. When the plunger is in the first water supply valve biasing position, the flush valve is closed and the flush valve linkage is in a non-actuating state. Actuation of the flush valve linkage by the flush valve linkage actuator, so as to open the flush valve, actuates the return actuator so as to bias the plunger into the second water supply valve biasing position.

In yet a further aspect, the manual water supply valve actuator includes a mechanical water supply valve linkage wherein a first portion of the linkage is contained within the tank, a second portion of the linkage, contiguous to the first portion, passes through a sealed first aperture in the tank, and a third portion of the linkage, contiguous to the second portion, extends from the sealed aperture to the water supply valve. The manual water supply valve actuator also includes a water supply valve linkage actuator cooperatively mounted to an end of the first portion of the linkage, opposite the second portion. The water supply valve linkage actuator is mounted through a second aperture in the tank.

In one embodiment of the present invention the mechanical water supply valve linkage is a flexible cable slidably mounted in a flexible cable cover. The cable cover is mounted at a first end to the second, or an upper, aperture in the tank. The plunger is journalled in the upper aperture and mounted at an inner end thereof to a corresponding first end of the flexible cable. The cable cover passes through the first, or a sealed lower, aperture in the tank. It extends to, and is mounted at, the water supply valve at a second end of the cable cover opposite the first end of the cable cover. A corresponding second end of the flexible cable cooperates with the water supply valve for opening and closing thereof.

Advantageously, the first or sealed lower aperture is formed in a tank mounting bolt, and the second or upper aperture is formed in the flush valve linkage actuator. Further, the flush valve linkage actuator is a lever and the water supply valve linkage actuator is a plunger having a push button at an outer end thereof, opposite the inner end. The push button has an edge thereof overlapping a portion of the lever. The return actuator is a wedge mounted between the portion of the lever and the edge of the push button. Rotation of the lever so as to actuate the flush valve linkage drives the wedge under the edge of the push button urging the push button outwardly of the lever thereby actuating the plunger into the first water supply valve biasing position.

In yet a further aspect of the present invention the upper and lower inserts are generally planar rigid members having secondary apertures for accepting mounting bolts therethrough. In particular, in one embodiment the upper and lower inserts are pedestals sized to generally correspond, respectively, to the size of the bases of the tank and bowl.

Further advantageously, the first and second conduits each have cavity portions extending as cavities through the corresponding generally planar rigid members. Rigid tube portions, contiguous to the corresponding cavity portions, extend from the cavity portions to the corresponding first and second outlets. The third conduit is a rigid tube, and the water turbine is mounted in a rigid housing at an upper end thereof.

In a further and alternative embodiment of this invention, the fan is driven by a mechanical drive means and the water supply valve is no longer required. The cable cover and mechanical linkage actuator, previously extending to the water supply valve, now extends directly from the sealed lower aperture formed in a tank mounting bolt to the upper end of the third conduit. The upper end of the third conduit has both a fan housing and a drive housing. The fan housing contains a fan, which is in fluid communication with both the first aperture formed in the upper insert and the water entry aperture in the upper surface of the bowl. Drive means is located in a separate drive housing so as to be isolated from the fan housing. Drive means, for example, in the form of a helical or leaf spring, can be tensioned by a user and is connected through an arrangement of gears to operate the fan. A second end of the mechanical linkage actuator projects into the drive housing for selectively regulating the release and operation of the tensioned spring.

In a yet further alternative embodiment of this invention, drive means is in the form of a battery operated electrical motor and the mechanical linkage actuator selectively closes electrical contacts permitting rotational output from the motor to operate the fan.

BRIEF DESCRIPTION OF THE DRAWINGS

FIG. 3 is a front elevational view, partially cut-away, of a standard flush toilet with the venting apparatus in place.

FIG. 4 is an enlarged detailed view of a portion of FIG. 3.

FIG. 9 is an isometric view, partially cut-away of the impeller and fan housing.

FIG. 10 is a sectional view at the upper end of the vent pipe.

FIG. 11 is an enlarged view of the control valve of the present invention illustrating the valve in the open position.

FIG. 12 is a sectional view of the control valve illustrating the valve in the closed position.

DETAILED DESCRIPTION OF PREFERRED EMBODIMENTS

Figure 1A:
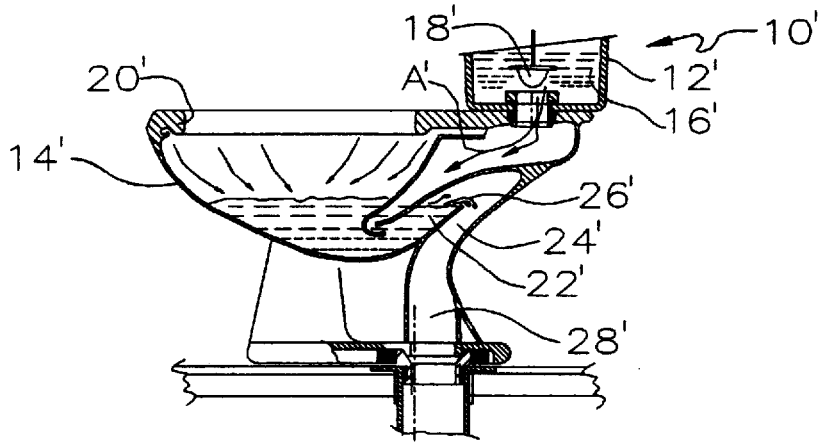
FIGS. 1A, 1B and 1C depict, in cut-away side elevation view, the operation of a conventional prior art toilet.
Figure 1B:
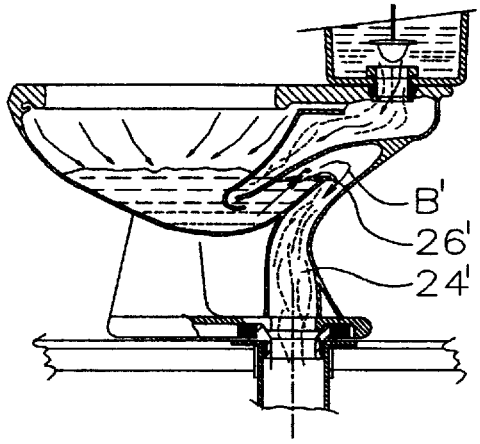
Figure 1C:
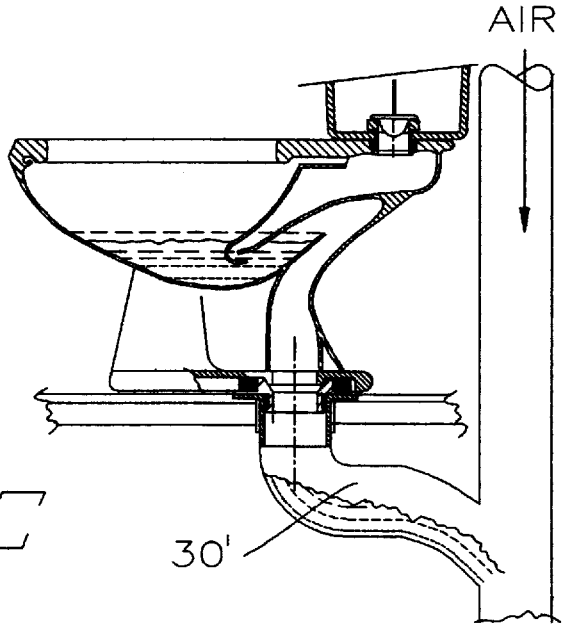
Fig 1C PRIOR ART

As seen in FIGS. 1A, 1B and 1C, prior art toilet 10' has a tank 12' and a bowl 14'. Water 16' in tank 12' flows into bowl 14' in direction A' when tank valve 18' is opened. Water is directed around the rim 20' of bowl 14' and flows into the bowl via a spaced-apart array of apertures under the rim. Water is also directed so as to flow upwardly in direction B' along up-leg 22' of pipe 24'. This floods pipe 24' so as to force the air pocket around apex 26' in pipe 24', down the down-leg 28' of pipe 24' and into sewer pipe 30', and causes a siphon effect which draws water continuously along pipe 24' into sewer pipe 30' until water is drained from bowl 14' and tank 12'.

As may be seen from the accompanying drawings the hydraulically actuated venting device 10, of the present invention, is connected to the water supply line 12 for the flush toilet through an auxiliary tee 14. A control valve 16, which is operated by rotation of a flush handle 18 mounted to the toilet tank 8, allows selective operation of the venting device 10 by the user. Control valve 16 is rigidly mounted relative to the toilet by being threaded onto the outwardly projecting end of a hollow tank hold down bolt 20. A flexible tube 21 extends between the inner end of hold down bolt 20 and flush handle 18. This arrangement permits a valve operating push rod 22, slidably journalled in tube 21, to pass through the toilet tank from flush handle 18 to control valve 16.

An upper insert 24 is fitted to the rear portion of the toilet bowl 6 and supports the toilet tank 8. A compartmentalised housing 26 contains a water driven impeller 28 and fan 29 (both shown in dotted outline in FIG. 9) mounted on a single axle for co-operative rotation. Housing 26 is mounted underneath and to the rear of upper insert 24. A lower insert 30 is positioned below the toilet bowl, between the toilet and the floor, and is connected to the impeller and fan housing 26 by a connecting vent pipe 32. The use of upper insert 24 and lower insert 30 allow venting device of the present invention to be retrofitted to conventional toilets.

Figure 5:
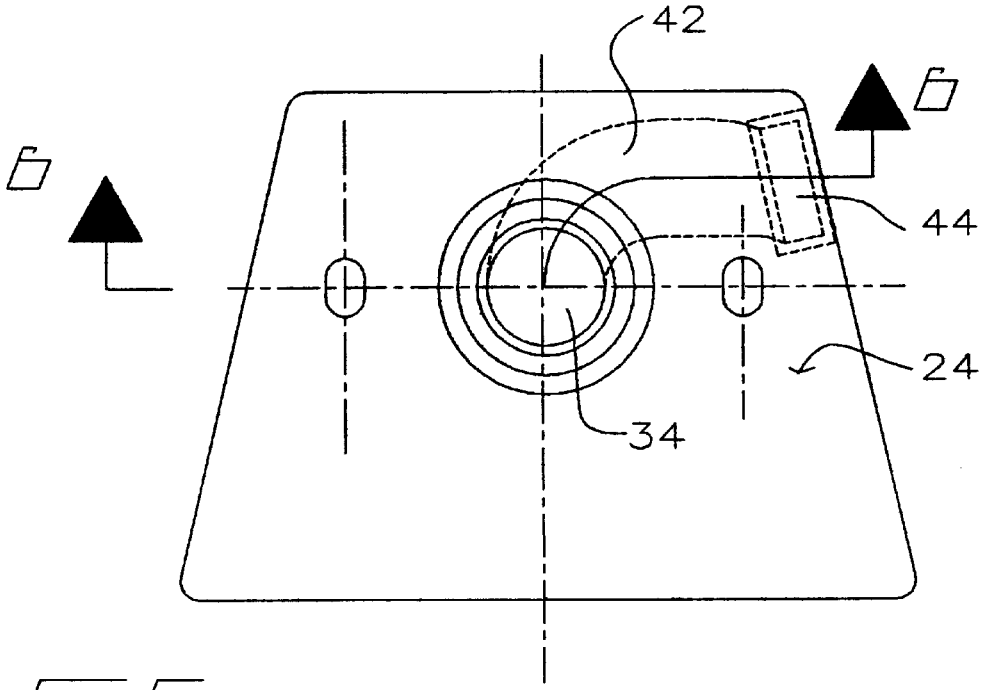
FIG. 5 is a plan view of the upper insert portion of the venting apparatus of the present invention.

Upper insert 24 has a through-aperture 34 which is conically shaped on its internal upper surface so as to cooperate with flush valve assembly 25. A conical gasket 25*a* forms a seal between the walls of aperture 34 and the discharge tube 25*b*. A lock washer threads onto the lower end of the discharge tube which projects downwardly from the bottom of tank 8. The underside of upper insert 24 has a projecting cylindrical lip 36 which has an annular recess 38 near the open end. This annular recess retains a lower gasket 40. Projecting lip 36 and gasket 40 mate with and seal the water entry aperture 6*a* located at the rear of the toilet bowl 6. Upper insert 24 has an internal passage 42 (shown in dotted outline in FIG. 5) which connects aperture 34 in fluid communication with a vent opening 44 located on the underside of upper insert 24. Inlet 26*a* of housing 26 mates into vent opening 44.

Figure 7:
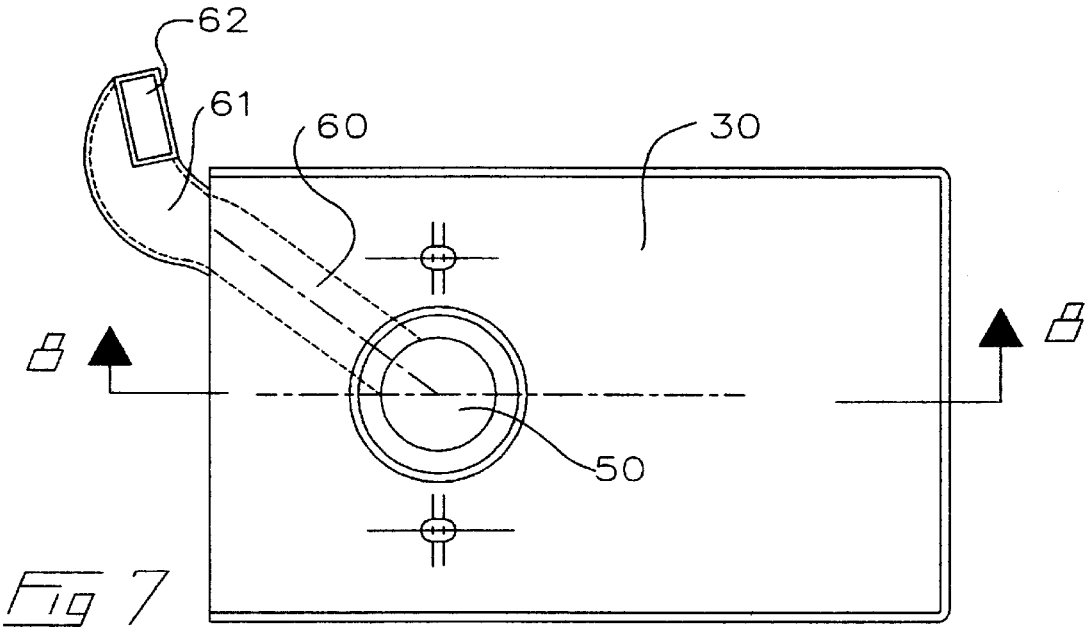
FIG. 7 is a plan view of the lower insert portion of the venting apparatus of the present invention.
Figure 8:
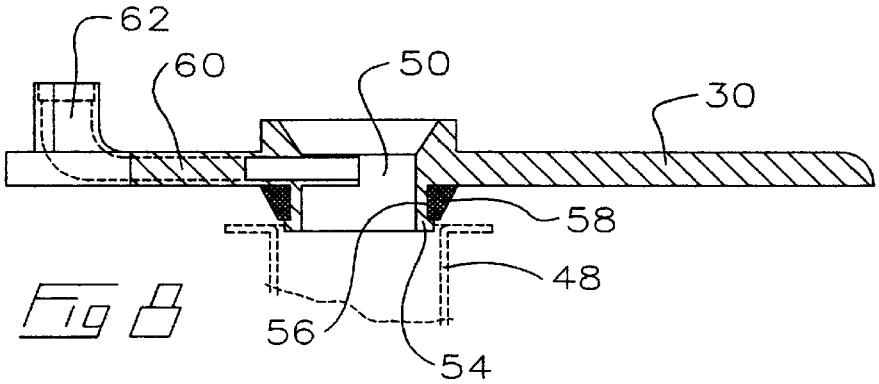
FIG. 8 is a sectional view along line 8—8 of FIG. 7.
Figure 13:
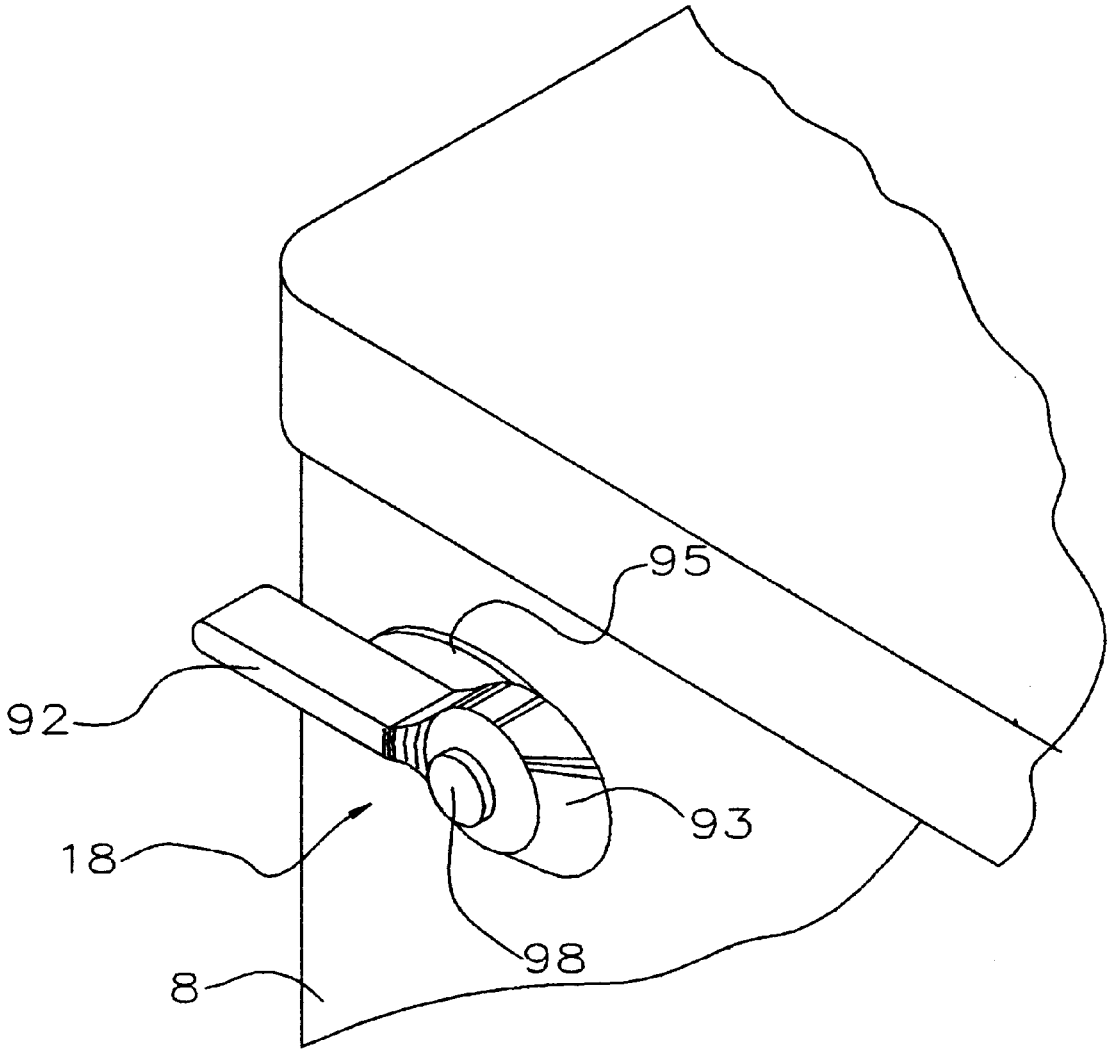

Lower insert 30 has a projecting lower lip 54. Through-aperture 50 extends through lower base 30 and lower lip 54. Lower lip 54 mates with floor waste pipe 48. An upper surface of aperture 50 mates with the toilet discharge aperture 52 which protrudes below toilet bowl 6. An annular recess 56 seen in FIG. 8 retains a compressible gasket 58. Lip 54 and gasket 58 provide a seal with floor waste pipe 48 when mated therein. Lower insert 30 has an internal passage 60 (seen in dotted outline in FIGS. 7 and 8) which connects aperture 50 in fluid communication with vent opening 62 located at the distal end of conduit 61 on lower insert 30. The lowermost end of pipe 32 mates onto vent opening 62.

The control valve 16 as illustrated in FIGS. 11 and 12 has a through-passage 70. Water from the water supply line 12 flows, via tee 14 and water take-off line 15, in direction A through control valve 16. Valve 16 is actuated by movement of pushrod 22 which may be a covered flexible cable and which extends from valve 16 to flush handle 18. The end 72 of push rod 22 is slidably fitted within valve 16 at right angles to passage 70. End 72 has aperture 74 formed therethrough in alignment with through-passage 70. End 72 of pushrod 22 has seals 76 positioned on either side of aperture 74. These seals prohibit water from flowing from passage 70 through hollow bolt 20 into the tank of the toilet. Alignment of aperture 74 in the end 72 of push rod 22 with through passage 70 in the control valve 16 permits water to flow to, so as to spray onto, impeller 28 in housing 26. As may be seen in FIG. 12, as pushrod 72 is drawn in direction B toward flush handle 18 during the rotation of flush handle 18, through passage 70 is sealed off stopping water flow through valve 16.

When the control valve 16 is in the open position, water passes via hose 17 from valve 16 to a nozzle 80 secured within the fan and impeller housing 26. Impeller 28 is rotated by water pressure from a spray of water from nozzle 80. Water is directed from impeller 28 downwardly through vent pipe 32. Flap valve 82 (shown in dotted outline in FIG. 1) is rotatably mounted near the upper end of the vent pipe 32. Water exiting housing 26 causes flap valve 82 to open.

Figure 2:
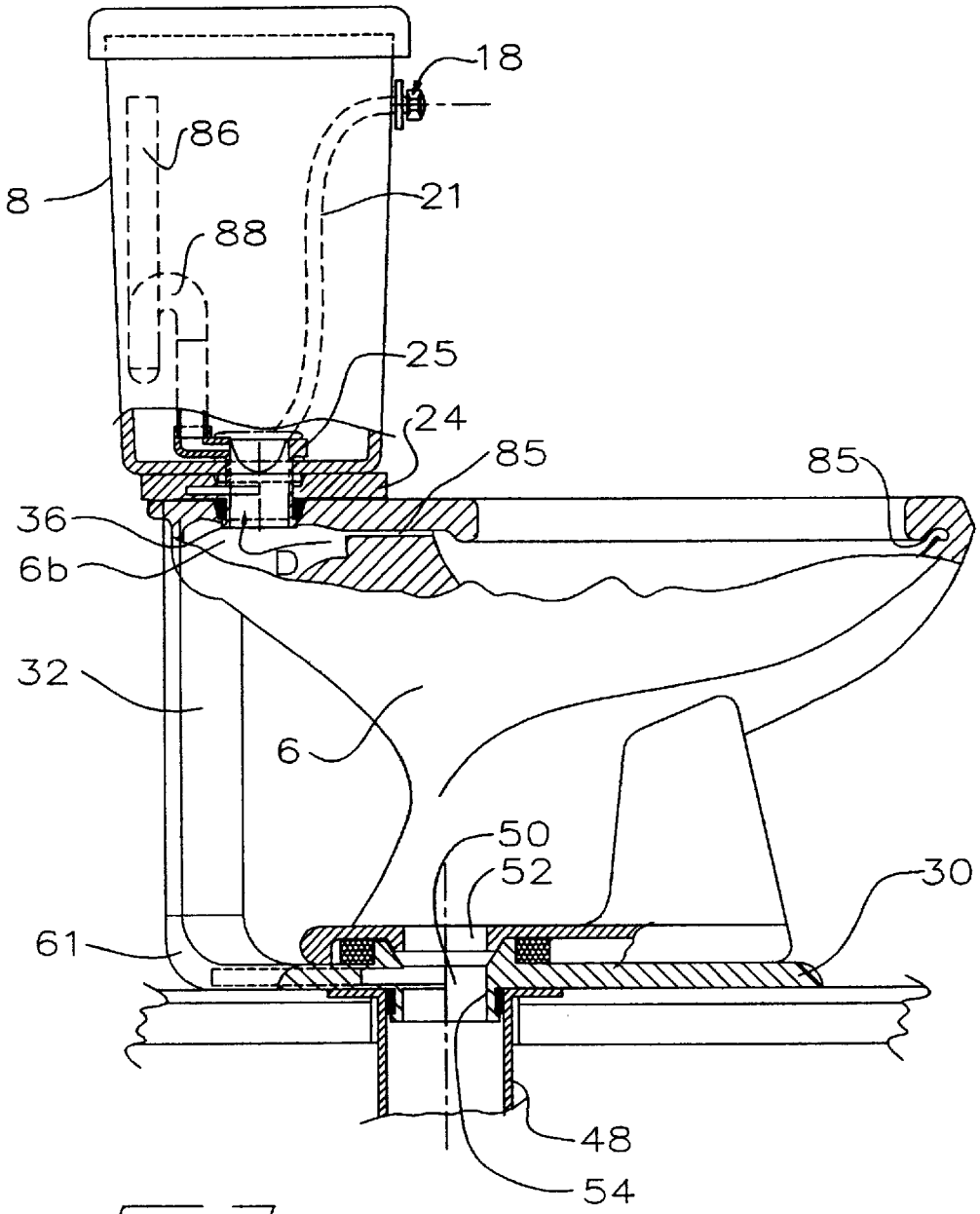
FIG. 2 is a side elevational view, partially cut-away, of a standard flush toilet with the venting apparatus in place.
Figure 6:
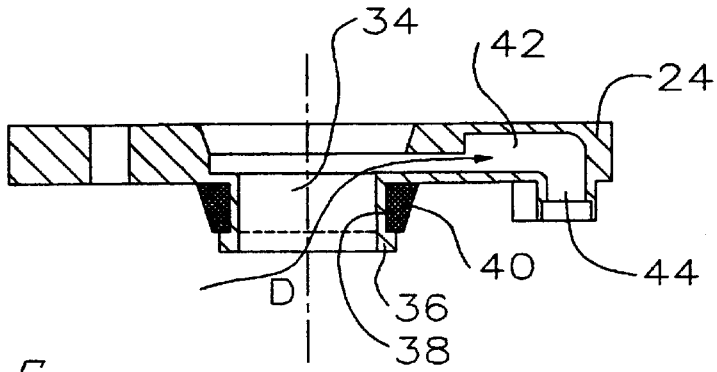
FIG. 6 is a sectional view along line 6—6 of FIG. 5.

As noted above, fan 29 and impeller 28 are mounted on a common shaft 84. Thus they co-operatively rotate, meaning that as impeller 28 rotates so too does fan 29. As impeller 28 is driven by water pressure from nozzle 80, fan 29 is rotated to draw air in direction D through the bowl chamber or manifold (hereinafter collectively manifold 6*b*) from the flush water discharge apertures 85 at the upper rim of the toilet bowl 6, as illustrated in FIG. 2. It is understood that, although only two such apertures are illustrated, there are a plurality of them in radially spaced array around the rim of the bowl. Air, which is intended to be odorous air from inside bowl 6, is drawn through firstly, apertures 85, then through internal passage 42 within upper insert 24 (seen in FIG. 6), so as to exit through aperture 44 into inlet 26*a* of housing 26. The air is forced downwardly by fan 29, through vent pipe 32, to exit, co-mingled with the water dropping from impeller 28, into sewer waste pipe 48 through lower insert 30.

Air is prevented from being drawn through overflow pipe 86 (seen in dotted outline in FIGS. 2 and 3) in the toilet tank 8 by a water trap 88. Flap valve 82 advantageously forms a tight seal within vent pipe 32 when the venting device is not in use to inhibit backflow of sewer gases. The flap valve may be of a design known in the art. Alternatively to accomplish the tight seal, as seen in FIG. 10, a depression 83 is formed in the upper surface of flap valve 82. Depression 83 retains a small amount of water and thus urges, by its weight, the flap valve downwardly in direction E about its pivots 82*a* to firmly seat the valve against the inner walls of vent pipe 32. Other actuating arrangements may be employed as would be known to one skilled in the art. For example, a mechanically actuated grate valve or shutter valve may be employed along the lines taught in the United States patent to Rose et al discussed above. A mechanical linkage may be taken off, for example, push rod 22.

Figures 1, 13:
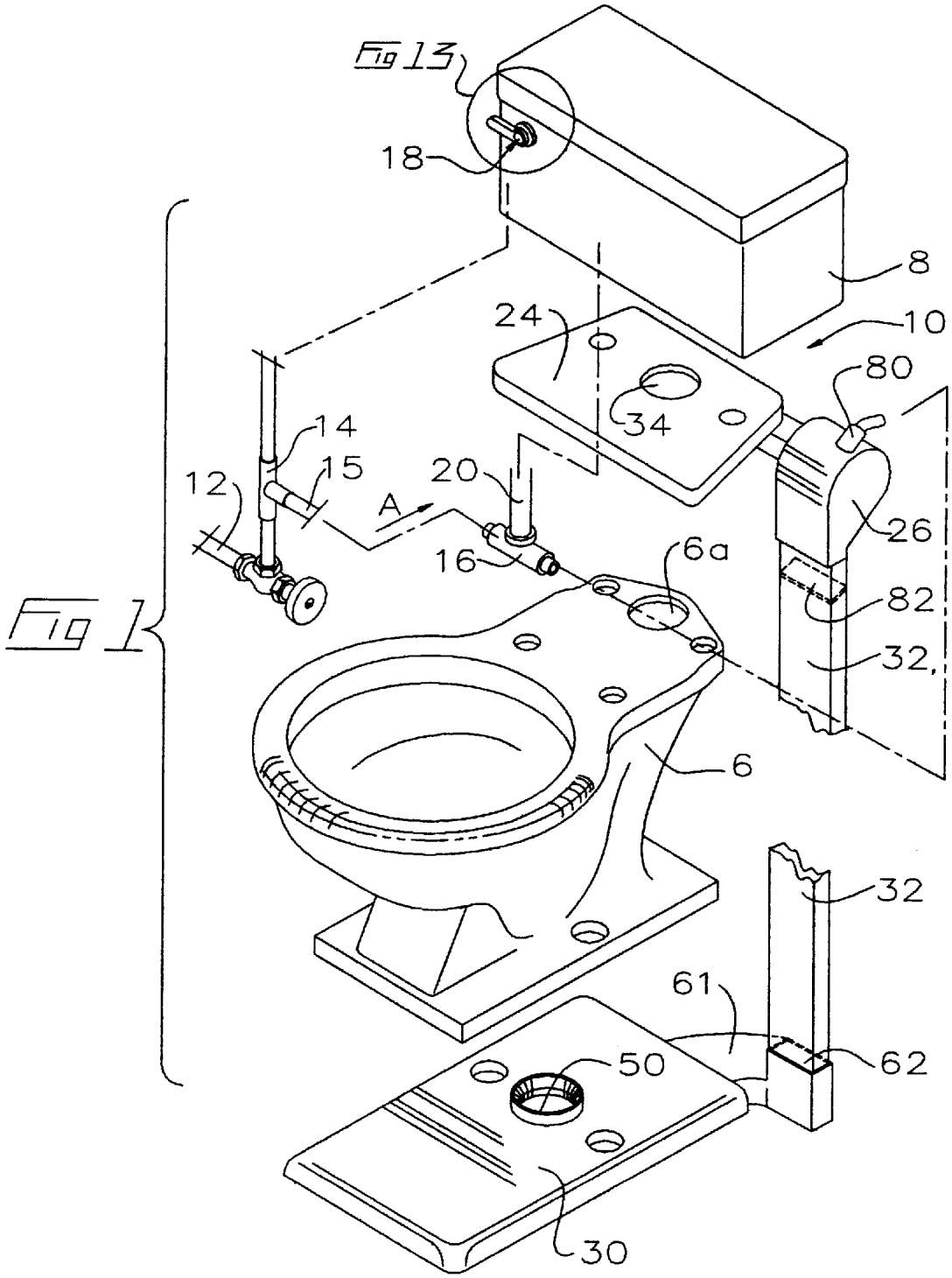
FIG. 1 is an exploded isometric view illustrating the components of the venting apparatus in relation to a standard flush toilet.
FIG. 13 is an enlarged perspective view of the flush handle of FIG. 1.
Figure 14A:
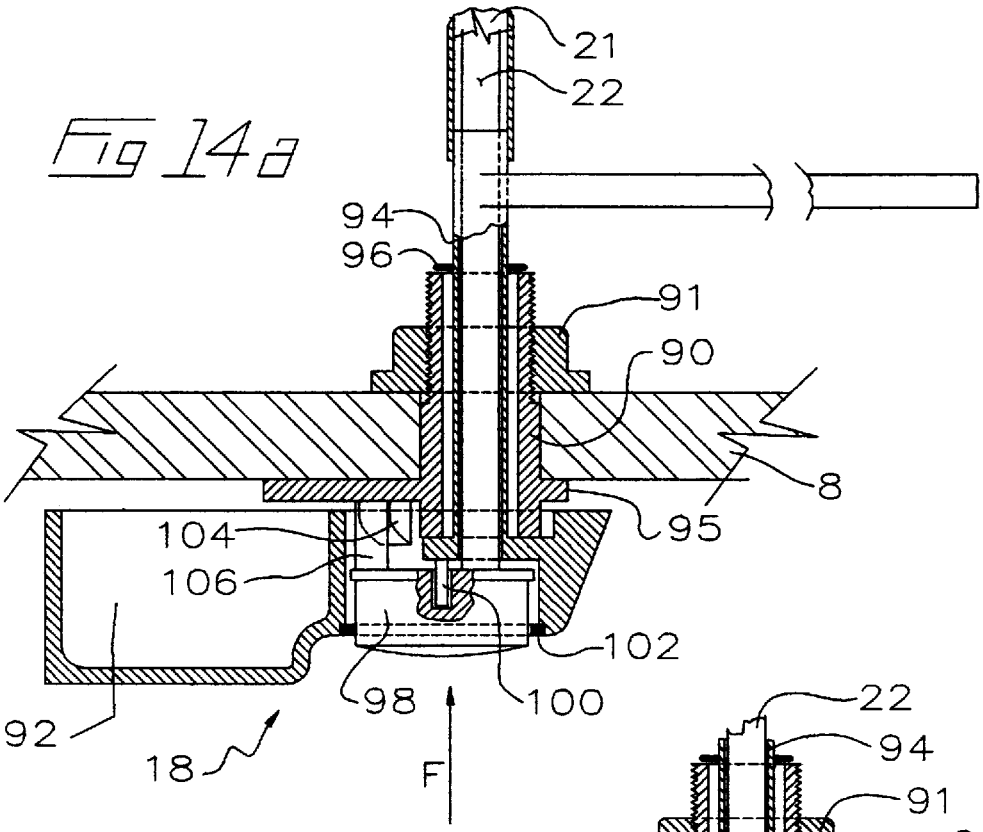
FIG. 14*a* is an enlarged sectional view of the flush handle and integral valve operating button, with the button in the valve open position.
Figure 14B:
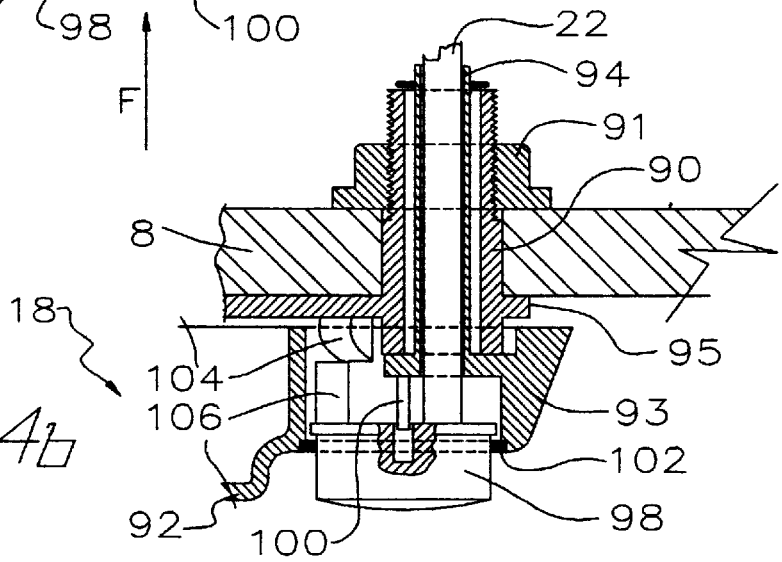
FIG. 14*b* is a sectional view of the flush handle illustrating the button in the valve closed position.
Figure 15:
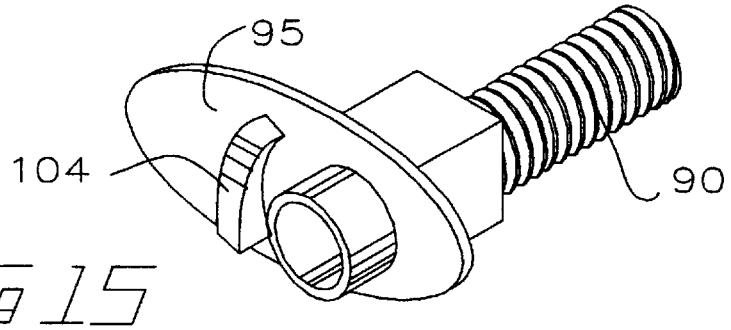
FIG. 15 is an isometric view of the stationary portion of the flush handle illustrating the button retraction mechanism.
Figure 16:
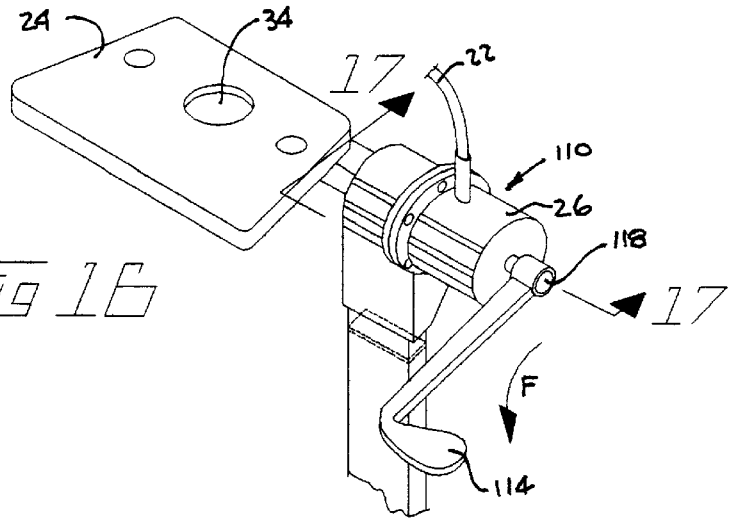
FIG. 16 is an isometric view of the modified fan and drive housing for a mechanically operated drive means.
Figure 17:
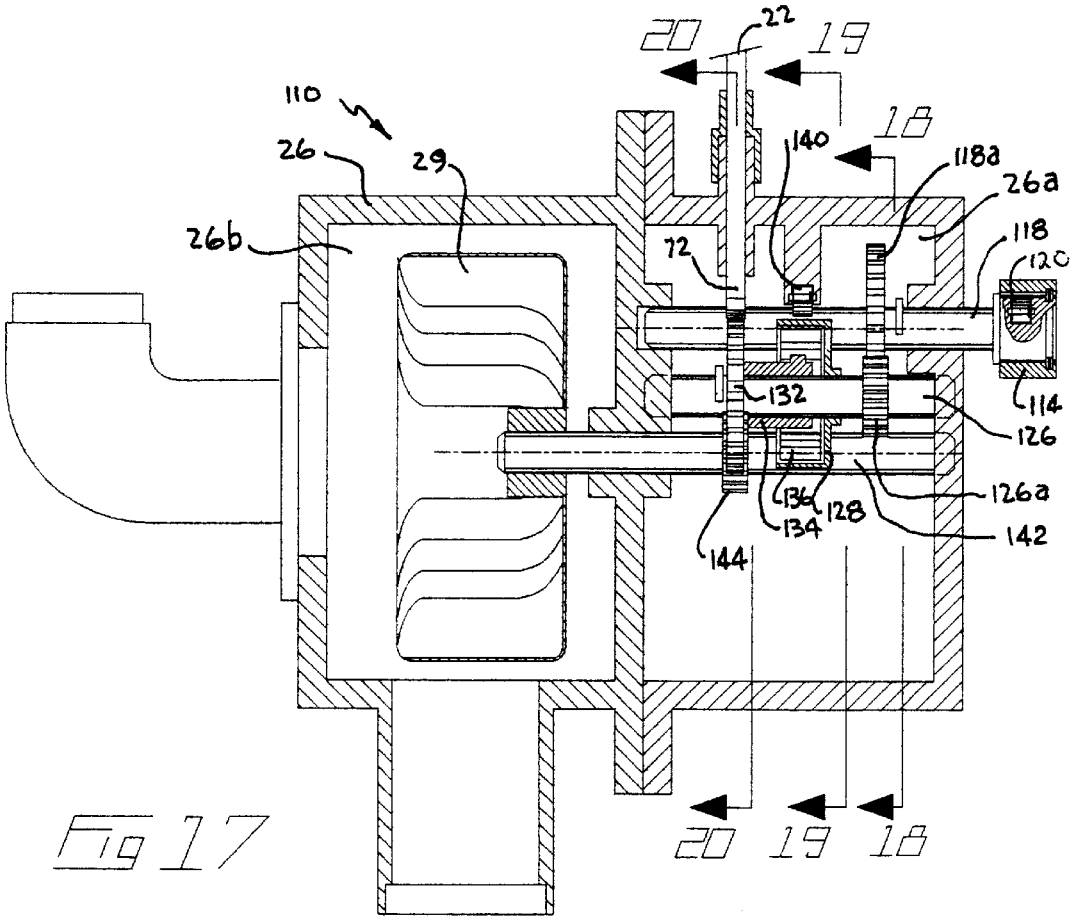
FIG. 17 is a partially sectioned front view along line 17—17 of FIG. 16.
Figure 18:
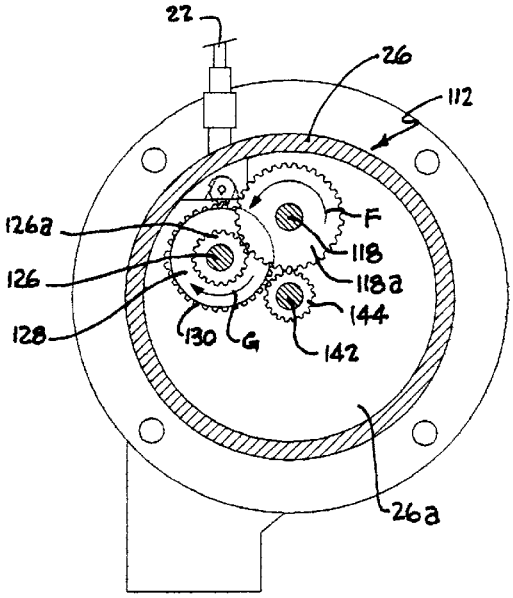
FIG. 18 is a sectional view along line 18—18 of FIG. 17.
Figure 19:
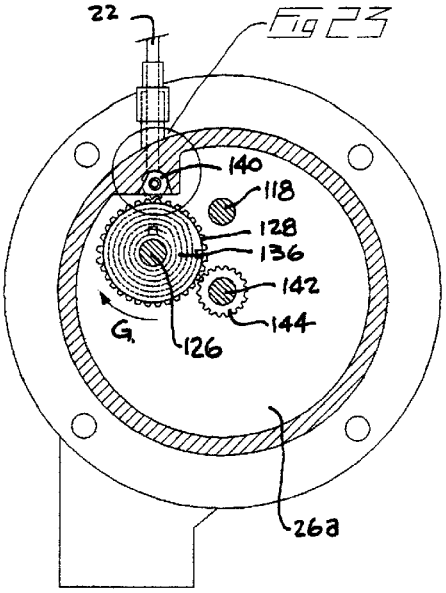
FIG. 19 is a sectional view along line 19—19 of FIG. 17.
Figure 20:
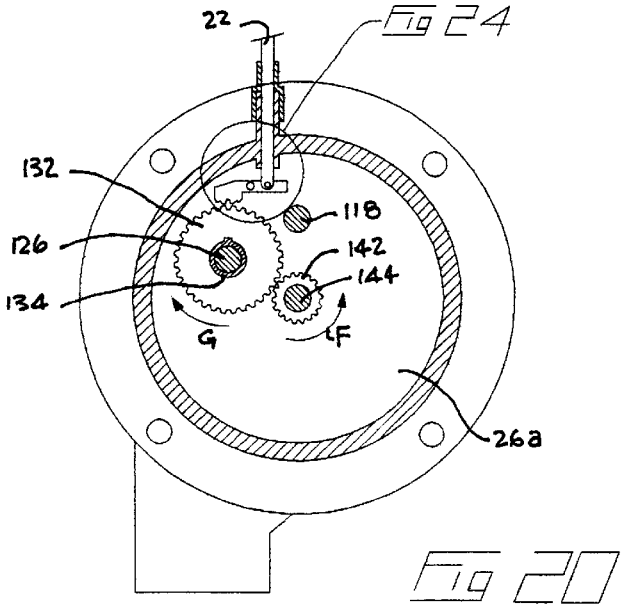
FIG. 20 is a sectional view along line 20—20 of FIG. 17.
Figure 21:
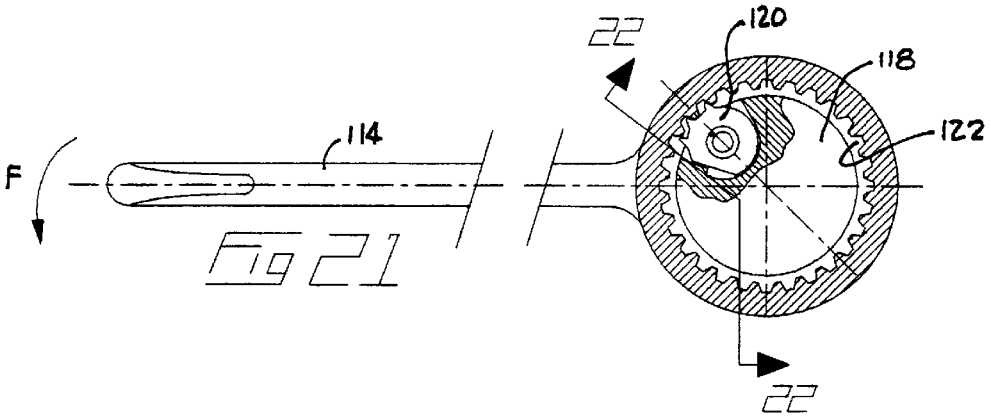
FIG. 21 is a side view of the operating handle partially in sectional view.
Figure 22:
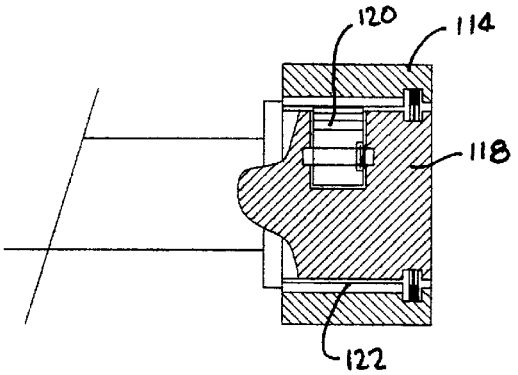
FIG. 22 is a sectional view along line 22—22 of FIG. 21.
Figure 23:
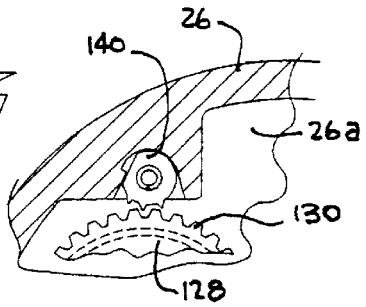
FIG. 23 is an enlarged view of a portion of FIG. 19.
Figure 24:
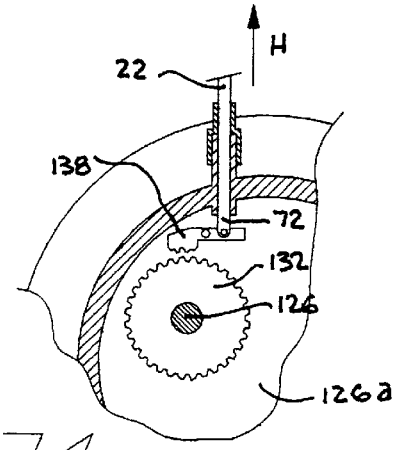
FIG. 24 is an enlarged view of a portion of FIG. 20.

As seen in FIGS. 13–15, flush handle 18 includes a mounting sleeve 90, which is non-rotatably secured to toilet tank 8 for example by means of a nut 91 threaded onto the inner end of the sleeve. An operating lever 92, has an elongate hollow shaft 94 inserted through the mounting sleeve and rotatably secured therein by a clip 96 or the like. Clip 96 is fitted over the inner end of hollow shaft 94. Push button 98 is slidably secured within the operating lever for rotation therewith as the lever is rotated to operate the flushing mechanism. Push button 98 is mounted on operating lever 92, for co-operative rotation therewith, within a mating annular collar 93. A lock pin 100 projects from operating lever 92 into a corresponding recess within push button 98. Button 98 is secured within annular collar 93 by a retaining ring 102. Button 98 has secured to its inner end valve operating rod 22 which passes through flexible tube 21 and hollow tank hold down bolt 20 into operating valve 16.

Mounting sleeve 90 has at its outer end a plate 95 which is drawn against tank 8 by the action of tightening nut 91 onto the inner end of the sleeve. An arcuately shaped push button reset wedge 104 is formed on plate 95. Reset wedge 104 slidably engages reset arm 106 on button 98. When button 98 is pushed inwards in direction F, valve operating rod 22 is advanced to open valve 16. When button 98 is in the reset position as shown in FIG. 14*b* valve 16 is in the closed position of FIG. 12 and handle 20 may be operated to flush the toilet without opening the valve 16 or operating the fan. Only when the button is depressed by the user will operating rod 22 be advanced to open the valve and permit water to flow to drive impeller 28 to thereby activate the venting operation. When the button 98 is in its depressed position the rotation of the lever 92 in a normal manner, when flushing the toilet for example, will reset the button and close valve 16 thereby terminating the venting operation.

An alternative embodiment 110 of this invention is illustrated in FIGS. 17 through 24, where the hydraulic means for actuating the venting apparatus has been replaced with a mechanical or "clock work" actuating means. Compartmentalised housing 26 contains a mechanical drive means 112 and fan 29 in discrete compartments 26*a* and 26*b* respectively. Only fan compartment 26*b* is connected in pneumatic communication with aperture 34 of upper insert 24 and vent opening 62 of lower insert 30.

Primary shaft 118 is installed within compartment 26*a* of housing 26 for rotation by rotation of an operating lever 114. Rotation of lever 114 in direction F causes cooperative synchronous rotation of primary shaft 118 by virtue of the locking action resulting between ratchet pawl 120 pivotally positioned in primary shaft 118 and internal ring gear 122 formed in operating lever 114. Counter-rotation of operating lever 114, in a direction opposite to direction F, results in a slight counter-rotation of ratchet pawl 120 permitting internal ring gear 122 to slide past pawl 120 without rotation of shaft 118 occurring. Ratchet pawl 120 is rotationally urged in direction F by a coil spring mounted to its pivot shaft to ensure minimum rotational movement when handle 114 is rotated in direction F. Fixedly mounted to primary shaft 118, for rotation therewith, also in direction F, is gear 118*a*.

A secondary shaft 126 has gear 126*a* fixedly mounted thereto which is in meshing contact with gear 118*a* for cooperative but counter-rotation therewith in direction G. Also fixedly mounted to shaft 126 is drive spring housing 128 which has a ring gear 130 formed on its external surface. Freely rotatably positioned on secondary shaft 126 is drive gear 132 which has an integrally formed hub 134. Drive spring housing 128 is open-faced adjacent to gear 132 and hub 134 nests within this recess. A helical drive spring 136 is also nested within the recess of housing 128 surrounding hub 134. Drive spring 136 has its outermost terminus fixed to housing 128 and its innermost end secured to hub 134.

Rotation of primary shaft 118 in direction F by operation of handle 114 in turn counter-rotates secondary shaft 126 in direction G. As drive spring 136 becomes tensioned, a second ratchet pawl 140 mounted within housing 26 and in meshing contact with ring gear 130 on drive spring housing 128 prohibits rotation of secondary shaft 126 in a direction opposite to direction G. Drive spring 136 now transfers rotational force to drive gear 132 which is freely rotatably mounted on secondary shaft 126.

Rotation of drive gear 132 is controlled through movement of pushrod 22, which may be a covered flexible cable, which extends from the mechanical drive means compartment 26*a* to flush handle 20. The end 72 of pushrod 22 is connected to a locking lever 138 which is pivotally mounted within compartment 26*a*. As flush handle 20 is operated, pushrod 22 is drawn outwardly from compartment 26*a*, in direction H, as button 98 is engaged by reset wedge 104. This results in the rotation of lever 138 into positive contact with drive gear 132, thus preventing rotation of drive gear 132. Only when button 98 is pushed in a direction opposite to direction H will lever 138 be released from engagement with drive gear 132 to permit free rotation of gear 132.

Fan 29 is fixedly mounted to shaft 142 which extends from fan compartment 26*b* into drive means compartment 26*a*. Shaft 142 has fan drive gear 144 fixedly mounted thereto in meshing engagement with drive gear 132.

When button 98 of flush handle 20 is pushed inwardly to commence the venting cycle rotation of drive gear 132 results in the rotation of fan drive gear 142 and fan 29.

It will be noted that a rotational advantage for tensioning drive spring 136, through operation of handle 114, can be derived by ensuring that the diameter of gear 118*a* is significantly larger relative to gear 126*a*. More efficient operation of fan 29 can be achieved where drive gear 132 is larger relative to gear 144. Sizing of drive spring 136 ensures that fan 29 rotates for a satisfactory length of time.

Figure 25:
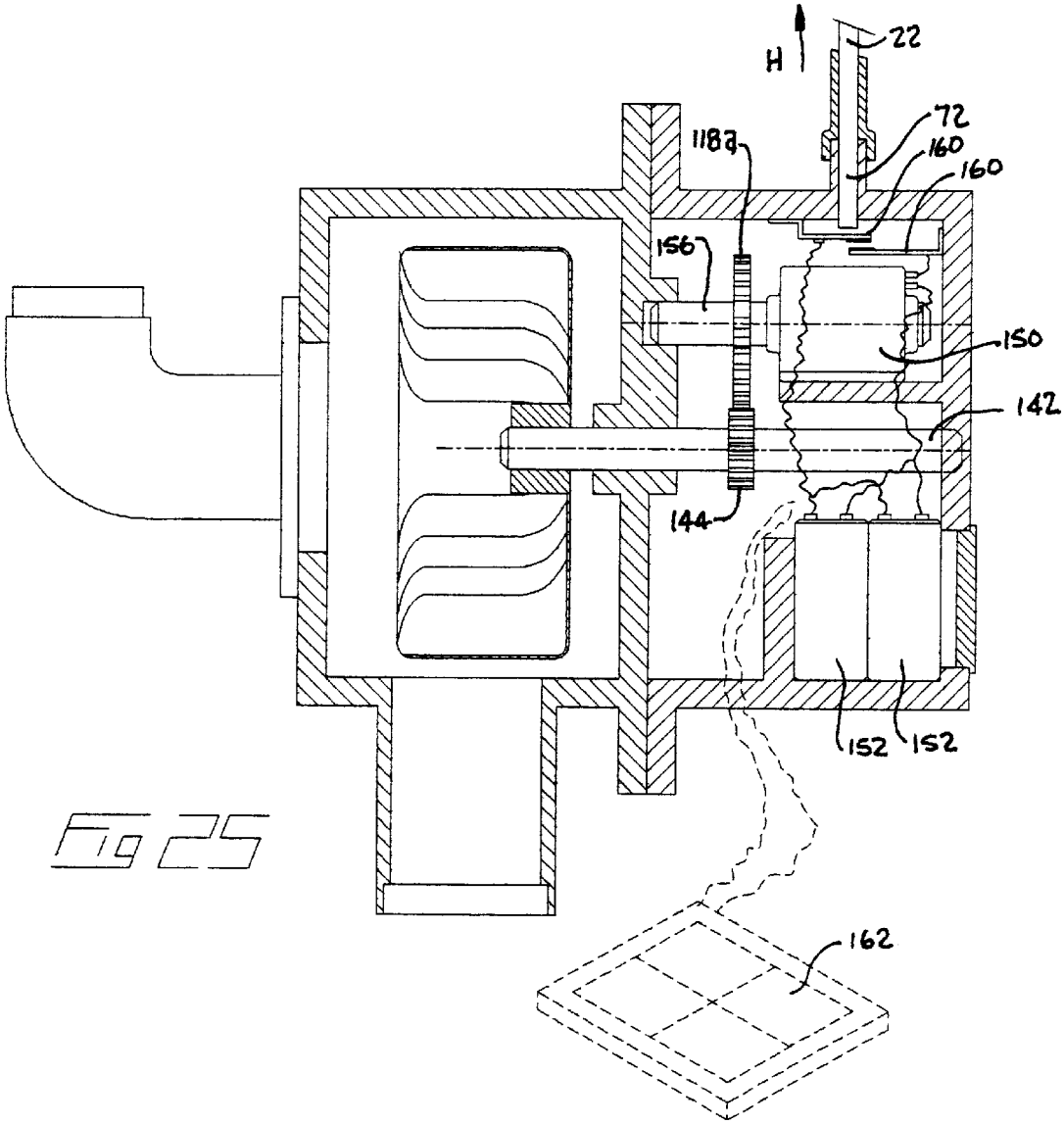
FIG. 25 is a partially sectioned front view of the modified fan and drive housing for an electrically operated drive means.

In a further embodiment of the invention seen in FIG. 25, the mechanical means for actuating the venting apparatus has been replaced with an electrically powered motor 150 which derives power from batteries 152. Drive gear 118*a* fixedly mounted to the drive shaft 156 of motor 150, engages fan drive gear 144 secured to fan drive shaft 142. Electrical contacts 160 are closed by end 72 of pushrod 22 when button 98 of flush handle 20 is pushed inwardly to commence the venting cycle. As flush handle 20 is operated, pushrod 22 is drawn outwardly from compartment 26*a*, in direction H, as button 98 is engaged by reset wedge 104. This results in opening of contacts 160 and cessation of the venting cycle.

It is anticipated that the batteries 152 may be rechargeable and a simple solar panel 162 connected to the electrical circuit would prolong the battery charge.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A toilet venting apparatus for a toilet, wherein said toilet includes a tank and a bowl, said apparatus comprising:

an upper insert mountable between said tank and said bowl, a lower insert mountable between said bowl and a floor sewer pipe, said upper insert having a first aperture for cooperating between a flush valve aperture in a lower wall of said tank and a water-entry aperture in an upper surface of said bowl, said water-entry aperture cooperating, via a manifold in said bowl, in fluid communication with water dispensing apertures around an upper rim of said bowl, a flush valve adapted for placement in said tank and actuable so as to release flush water held in said tank through said flush valve aperture, said first aperture, said water-entry aperture, said manifold and said water dispensing apertures to thereby flush said toilet, said upper insert having a first conduit in fluid communication with said first aperture, said first conduit extending from said first aperture to a first outlet said first outlet opening externally from said upper insert, said lower insert having a second aperture for cooperating between a down-leg discharge aperture of said bowl and an inlet aperture of said floor sewer pipe, a third conduit mountable in fluid communication between said first and second outlets, a motor driven turbine mounted to said third conduit, said motor driven turbine having a motor cooperating with a drive shaft and fan, an actuator for biasing a motor actuating switch of said motor driven turbine so as to actuate said motor and said drive shaft to thereby turn said fan, said fan in fluid communication with said third conduit, wherein said actuator is a manual actuator manually translationally movable between first and second biasing positions, wherein in said first biasing position said motor actuating switch is biased into a motor operative position, said apparatus further including a flush valve linkage for actuating said flush valve and a return actuator cooperating with said flush valve linkage, said manual actuator being biased from said first biasing position to said second biasing position by movement of said flush valve linkage, which moves said return actuator into biasing contact with said manual actuator, wherein in said second biasing position said motor actuating switch is biased into a motor disabling position, wherein, when said first insert is mounted between said tank and said bowl, and said second insert is mounted between said bowl and said floor sewer pipe, and said third conduit is mounted to said first and second outlets, turning of said drive shaft turns said fan so as to draw air into said third conduit from said bowl via said water dispensing apertures, said manifold and said first conduit, said fan urging said air down said third conduit, so as to pass through said second conduit and into said floor sewer pipe.

2. The apparatus of claim 1 wherein said manual actuator is a plunger, said plunger mounted to a first end of a mechanical motor actuating switch linkage, an opposite second end of said motor actuating switch linkage cooperating with said motor actuating switch for opening and closing said motor actuating switch upon corresponding translation of said plunger, said plunger cooperatively mounted to a flush valve linkage actuator, wherein when said plunger is in said first motor actuating switch biasing position, said flush valve is closed and said flush valve linkage is in a non-actuating state, and wherein actuation of said flush valve linkage by said flush valve linkage actuator, so as to open said flush valve, actuates said return actuator so as to bias said plunger into said second motor actuating switch biasing position.

3. The apparatus of claim 2 wherein said mechanical motor actuating switch linkage is a flexible cable slidably mounted in a flexible cable cover, said cable cover mountable at a first end to an upper aperture in said tank, said plunger mountable in journalled relation through said upper aperture in said tank, said cable cover adapted for passing through a lower aperture in said tank.

4. The apparatus of claim 3 wherein said lower aperture is formed in a tank mounting bolt that is adapted for connection to the tank.

5. The apparatus of claim 4 wherein said upper aperture is formed in a flush valve linkage actuator.

6. The apparatus of claim 5 wherein said flush valve linkage actuator is a lever, said motor actuating switch linkage actuator is a plunger having a push button at an outer end thereof, opposite said inner end, and said push button having an edge thereof overlapping a portion of said lever, and said return actuator is a wedge mounted between said portion of said lever and said edge of said push button, wherein rotation of said lever so as to actuate said flush valve linkage drives said wedge under said edge of said push button urging said push button outwardly of said lever thereby actuating said plunger into said second motor actuating switch biasing position.

7. The apparatus of claim 1 wherein said manual motor actuating switch actuator includes a mechanical motor actuating switch linkage, a first portion of said linkage adapted to be contained within said tank, a second portion of said linkage, contiguous to said first portion, adapted for passing through a lower aperture in said tank, a third portion of said linkage, contiguous to said second portion, extending from said lower aperture in said tank to said motor actuations switch, and wherein said manual motor actuating switch actuator includes a motor actuating switch linkage actuator cooperatively mounted to an lend of said first portion of said linkage opposite said second portion, said motor actuating switch linkage actuator adapted to be mounted through an upper aperture in said tank.

8. The apparatus of claim 3 wherein said mechanical motor actuating switch linkage is a flexible cable slidably housed in a flexible cover, and wherein said lower aperture is formed in a tank mounting bolt, and wherein said upper aperture is formed in a flush valve linkage actuator.

9. The apparatus of claim 8 wherein said flush valve linkage actuator is a lever.

10. The apparatus of claim 9 wherein said manual actuator is a plunger, and wherein said plunger has an inner and an outer end, a push button mounted at said outer end, said push button having an edge thereof overlapping a portion of said lever, and said return actuator is a wedge mounted between said portion of said lever and said edge of said push button, wherein rotation of said lever so as to actuate said flush valve linkage drives said wedge under said edge of said push button urging said push button outwardly of said lever thereby actuating said plunger into said second motor actuating switch biasing position.

11. The apparatus of claim 1 wherein said upper and lower inserts are generally planar rigid members.

12. The apparatus of claim 11 wherein said planar rigid members have secondary apertures for accepting mounting bolts therethrough.

13. The apparatus of claim 12 wherein said upper and lower inserts are pedestals sized to generally correspond, respectively, to the size of bases of said tank and bowl.

14. The apparatus of claim 11 wherein said first and second conduits each have cavity portions extending as cavities through corresponding said generally planar rigid members, and rigid tube portions contiguous to corresponding said cavity portions extending from said cavity portions to corresponding said first and second outlets.

15. The apparatus of claim 14 wherein said third conduit is a rigid tube, and said motor driven turbine is mounted in a rigid housing at an upper end of said third conduit.

* * * * *